US007874943B1

(12) United States Patent
Chen

(10) Patent No.: US 7,874,943 B1
(45) Date of Patent: Jan. 25, 2011

(54) SAFETY BASEBALL BASE

(75) Inventor: Shyan-Wei Chen, Taipei Hsien (TW)

(73) Assignee: Racer Sporting Goods Co., Ltd., Taipei Hsien (TW)

( * ) Notice: Subject to any disclaimer, the term of this patent is extended or adjusted under 35 U.S.C. 154(b) by 0 days.

(21) Appl. No.: 12/631,096

(22) Filed: Dec. 4, 2009

(51) Int. Cl.
*A63B 71/00* (2006.01)

(52) U.S. Cl. ..... 473/501; 473/499

(58) Field of Classification Search ..... 473/499, 473/500, 501, 497, 451
See application file for complete search history.

(56) References Cited

U.S. PATENT DOCUMENTS 3,126,203 A * 3/1964 Bourret ..... 473/499
3,204,958 A * 9/1965 Velasquez ..... 473/499
3,508,747 A * 4/1970 Orsatti ..... 473/499
3,572,705 A * 3/1971 Wyble ..... 473/499
3,862,756 A * 1/1975 Selliken ..... 473/501
3,971,558 A * 7/1976 Gardetto ..... 473/499
4,266,768 A * 5/1981 Hall ..... 473/501
4,723,779 A * 2/1988 Hauser ..... 473/499
4,830,368 A * 5/1989 Green et al. ..... 473/501

* cited by examiner

*Primary Examiner*—Mitra Aryanpour

(57) ABSTRACT

A safety baseball base includes a base with a bottom recess and a bottom stem in the bottom recess, an anchor embedded in the ground in a baseball field, a positioning member inserted into the anchor, a flexible mounting plate affixed to the positioning member and having recessed holes on the top side, and a flexible coupling member fitted into the bottom recess around the bottom stem and affixed to the base and having a plurality of bottom locating blocks respectively engaged into the recessed holes of the flexible mounting plate to secure the base to the flexible mounting plate for allowing disconnection of the base from the flexible mounting plate upon an impact to avoid injuries when a player is sliding into the base.

8 Claims, 14 Drawing Sheets

SAFETY BASEBALL BASE

BACKGROUND OF THE INVENTION

1. Field of the Invention

The present invention relates to a baseball base for baseball game and more particularly, to a safety baseball base, which allows disconnection of the base from the anchor upon an impact to avoid injuries when a player is sliding into the base.

2. Description of the Related Art

A regular baseball base for first, second or third base in a baseball field generally comprises an anchor 7 embedded in the ground, a base 8, and a positioning member 9 affixed to the bottom side of the base 8 with screws 81 and inserted with its bottom end 91 into the receptacle 71 of the anchor 7 to secure the base 8 firmly to the anchor 7. After insertion of the positioning member 9 into the receptacle 71 of the anchor 7, the base 8 is secured to the anchor 7 firmly in place. When a player slides into the base, the impact force produced between the base 8 and the player may cause the player to get injured. Therefore, the Minor League Baseball established a rule to use detachable baseball base from the year 2008.

SUMMARY OF THE INVENTION

The present invention has been accomplished by providing an improved base in order to overcome shortcomings known in the baseball base art. It is one object of the present invention to provide a safety baseball base, which allows disconnection of the base from the anchor upon an impact to avoid injuries when a player is sliding into the base. It is another object of the present invention to provide a flexible mounting plate and a flexible coupling plate for use in a conventional baseball base to allow disconnection of the base from the anchor upon an impact when a player is sliding into the base, avoiding injury.

To achieve these and other objects of the present invention, the safety baseball base comprises a base, which comprises a bottom recess, a bottom stem downwardly suspending at the center of the bottom recess and a plurality of bottom mounting holes formed in the bottom recess around the bottom stem, an anchor fixedly fastened to the ground of a baseball field in a flush manner and having a receptacle, a positioning member inserted into the receptacle of the anchor for securing the base to the anchor and having a plurality of mounting through holes disposed at the top side, a flexible mounting plate, which has a plurality of mounting through holes respectively fastened to the mounting through holes of the positioning member with fastening members and a plurality of recessed holes respectively formed on the top side thereof, each recessed hole having a plurality of sloping inside walls, and a flexible coupling plate fitted into the bottom recess of the base and fastened to the base and detachably coupled to the flexible mounting plate to detachably secure the base to the flexible mounting plate. The flexible coupling plate comprises a center through hole coupled to the bottom stem of the base, a plurality of mounting through holes respectively affixed to the bottom mounting holes of the base with respective fastening members, and a plurality of bottom locating blocks respectively inserted into the recessed holes of the flexible mounting plate to detachably secure the flexible coupling plate to the flexible mounting plate.

DETAILED DESCRIPTION OF THE INVENTION

Figure 1:
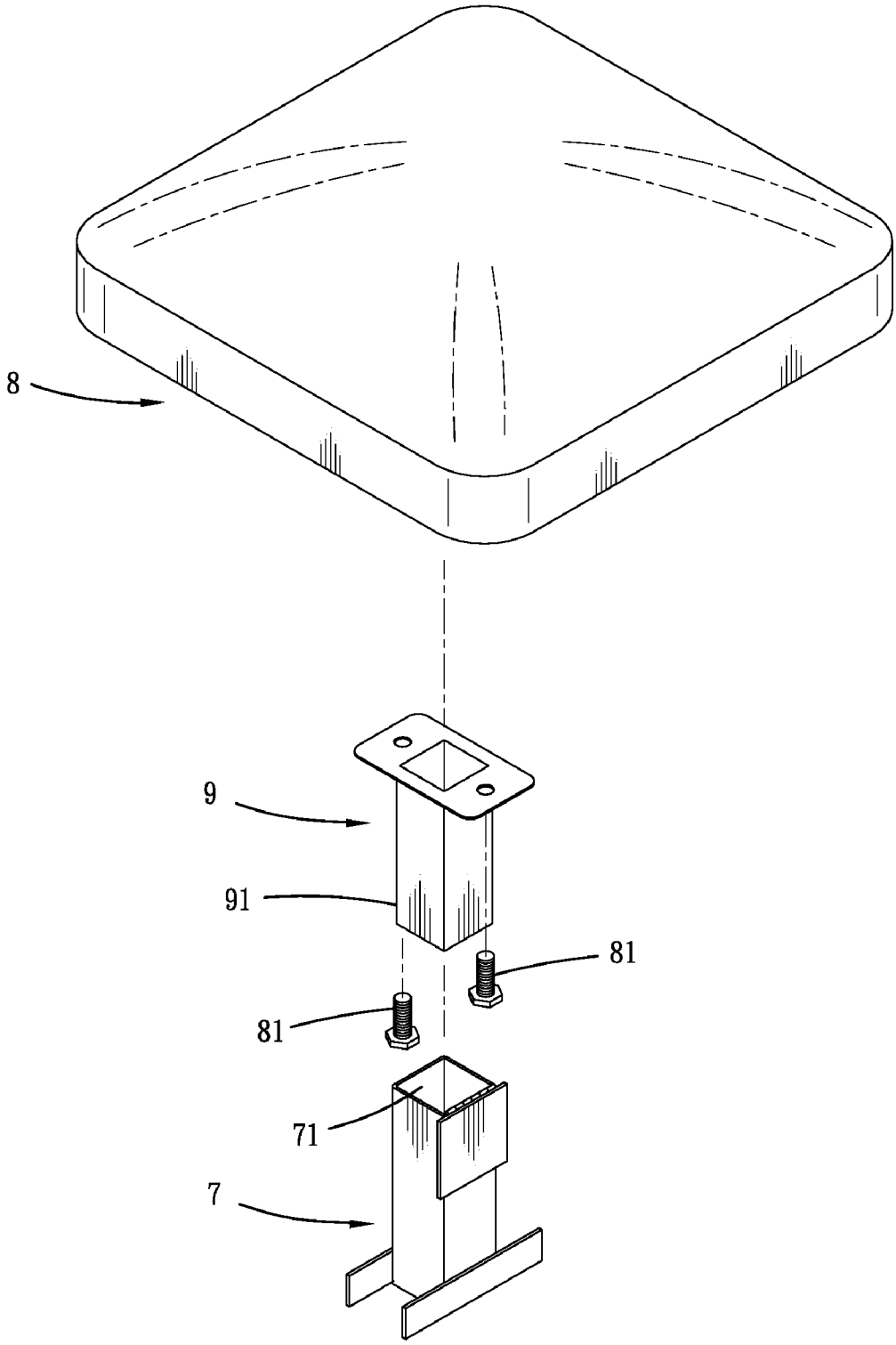
Fig. 1 PRIOR ART
FIG. 1 is an exploded oblique top view of a baseball base according to the prior art.
Figure 2:
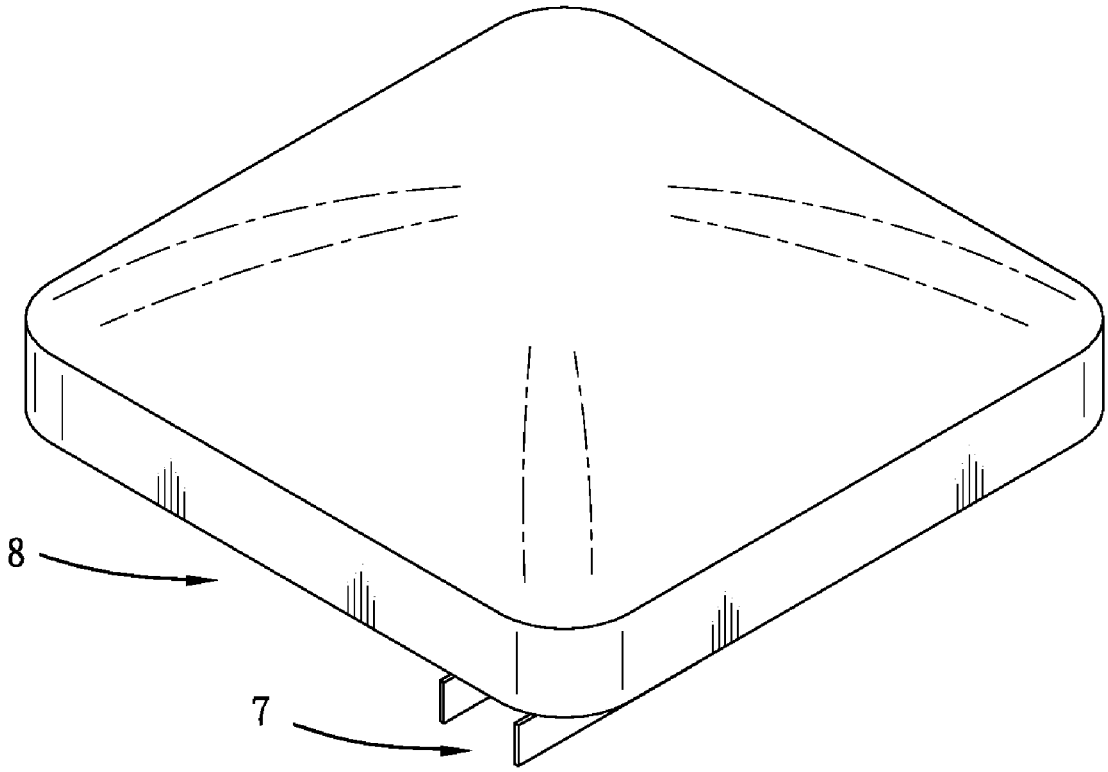
Fig. 2 PRIOR ART
FIG. 2 is an oblique top elevational assembly view of the baseball base according to the prior art.
Figure 3:
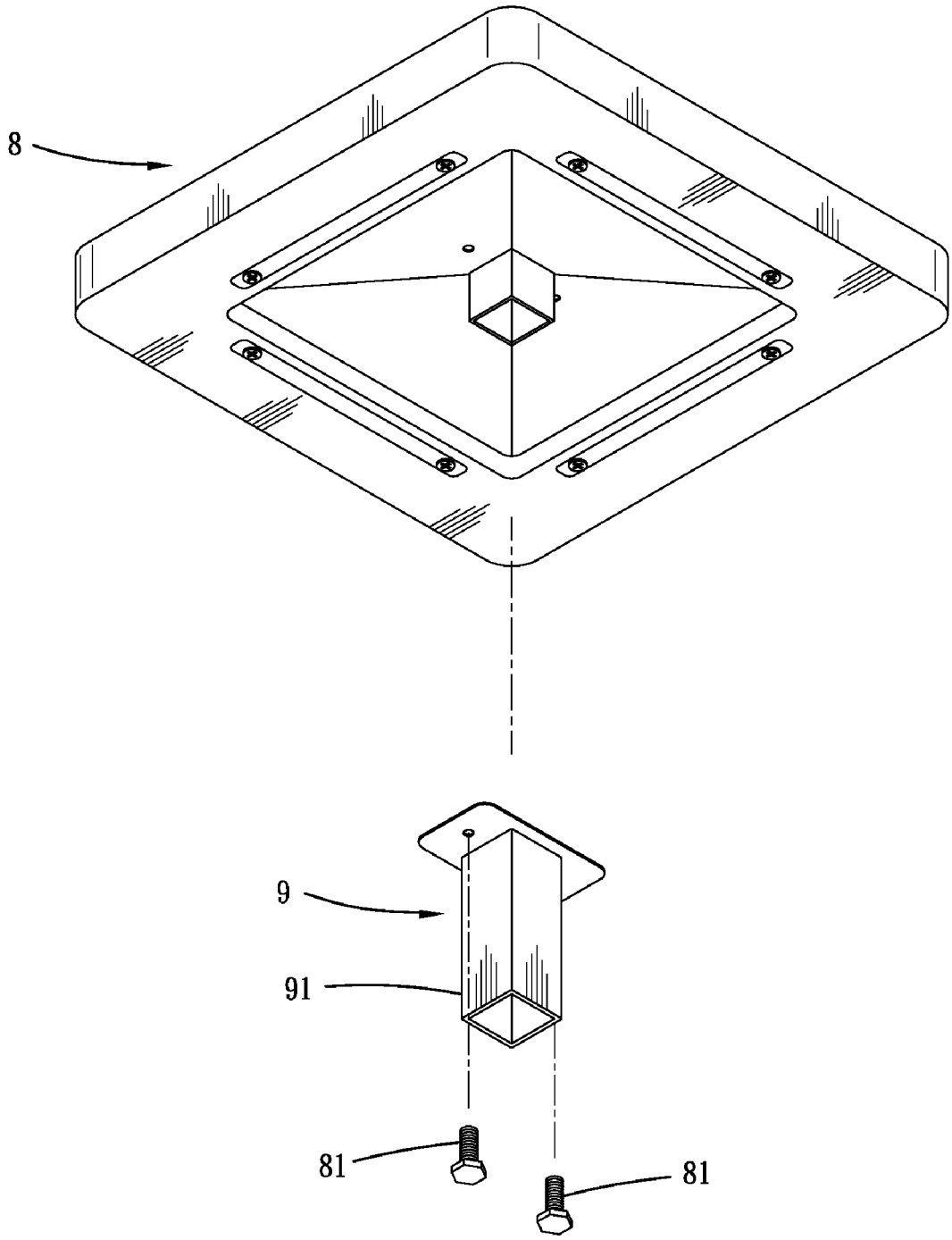
Fig. 3 PRIOR ART
FIG. 3 is an exploded oblique bottom view of a part of the baseball base according to the prior art.
Figure 4:
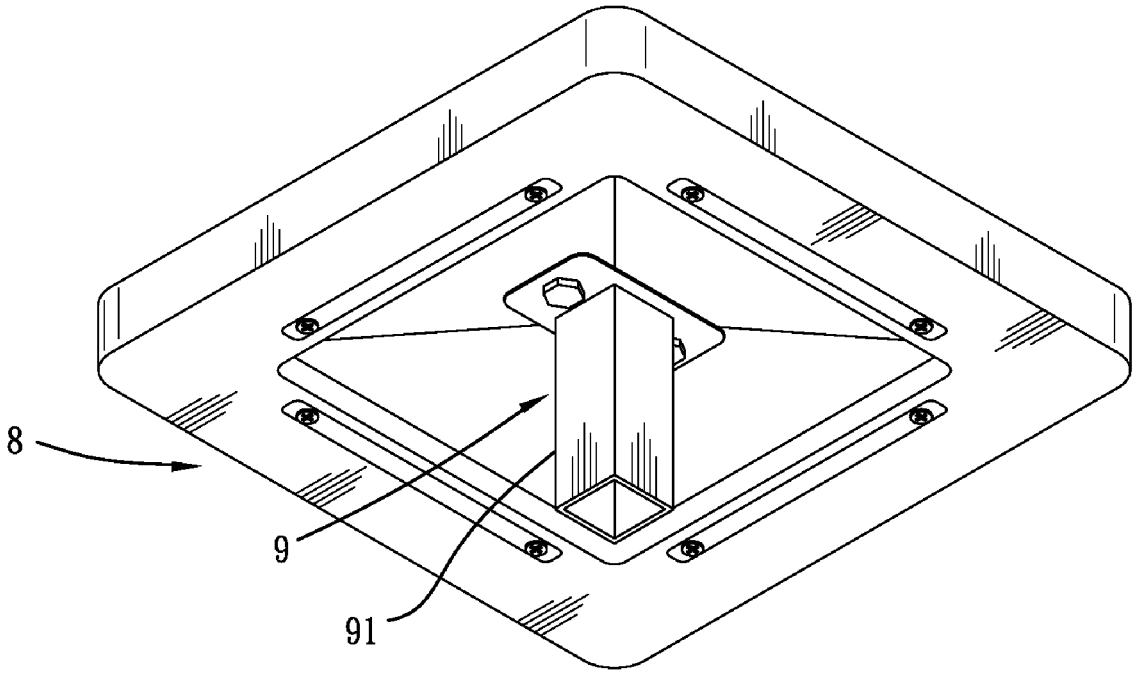
Fig. 4 PRIOR ART
FIG. 4 is an oblique bottom elevational assembly view of the baseball base according to the prior art (the anchor excluded).

Referring to FIGS. 5-14, a safety baseball base can be installed in a baseball field to work as the first, second or third base, comprising a base 6, a positioning member 4, an anchor 5, a mounting plate 1, and a coupling plate 2.

The base 6 has a bottom recess 60, a bottom stem 61 downwardly suspending at the center of the bottom recess 60, and a plurality of bottom mounting holes 62 formed in the bottom recess 60 around the bottom stem 61. According to the present preferred embodiment, the bottom stem 61 is a hollow rectangular stem.

The positioning member 4 has a plurality of mounting through holes 41 disposed at the top. The bottom end 42 of the positioning member 4 is insertable into the inside of the anchor 5.

The anchor 5 is fixedly fastened to the ground of the baseball field in a flush manner, having a receptacle 51 for receiving the bottom end 42 of the positioning member 4.

The mounting plate 1 has a plurality of mounting through holes (countersunk holes) 11 respectively fastened to the mounting through holes 41 of the positioning member 4 with screws 31 and nuts 32 (see FIGS. 6 and 9) so that the mounting plate 1 can be fastened with the positioning member 4 to the receptacle 51 of the anchor 5. The mounting plate 1 further has a plurality of recessed holes 12 respectively formed on the top side in the four corners. Each recessed hole 12 has a plurality of sloping inside walls 121. Further, the mounting plate 1 is made out of a flexible material, such as natural rubber, artificial rubber, or thermoplastic rubber. The recessed holes 12 are disposed in the four corners of the mounting plate 1 close to the periphery 13 of the mounting plate 1.

Figure 5:
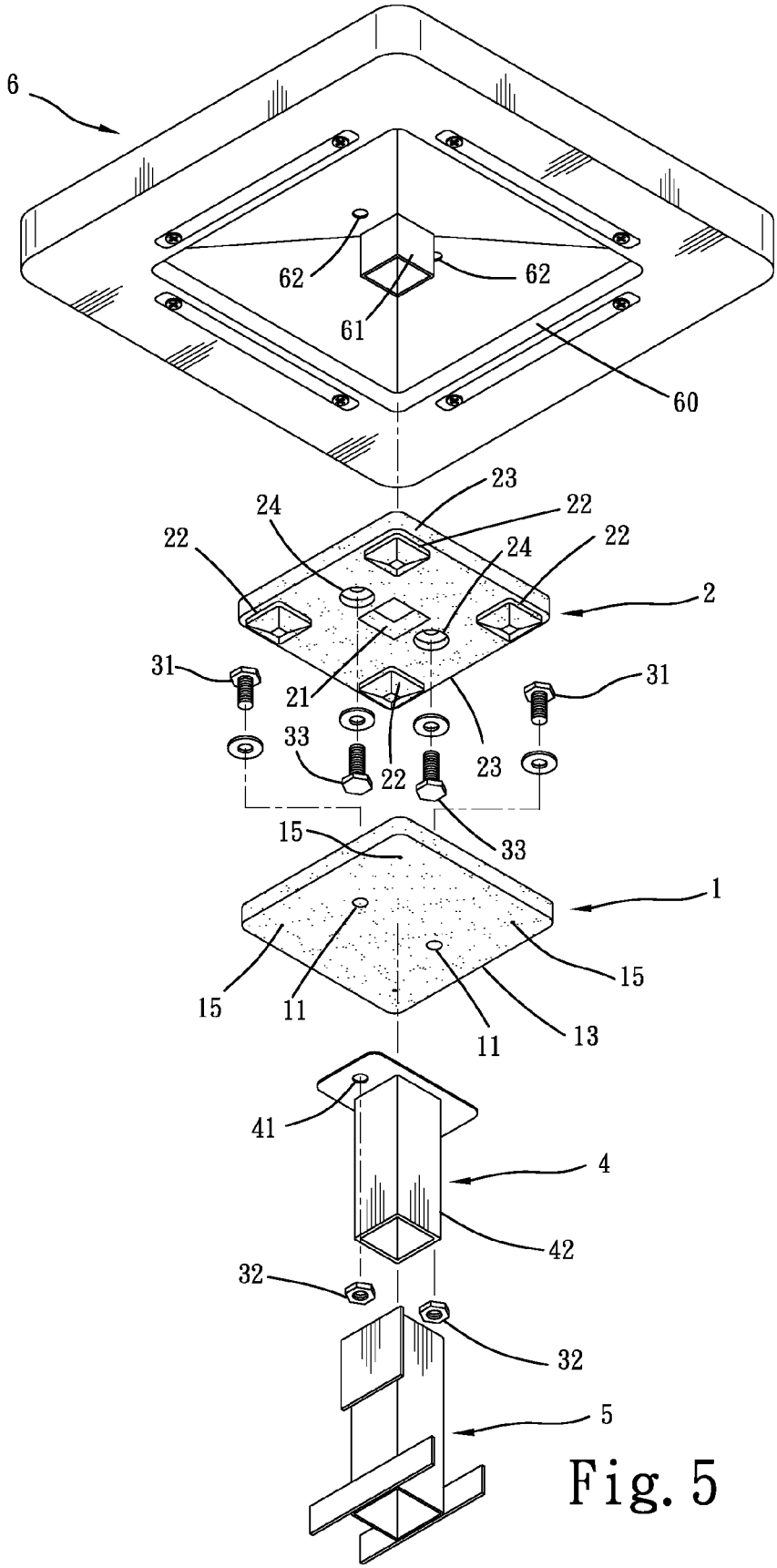
FIG. 5 is an exploded oblique bottom view of a safety baseball base in accordance with the present invention.
Figure 6:
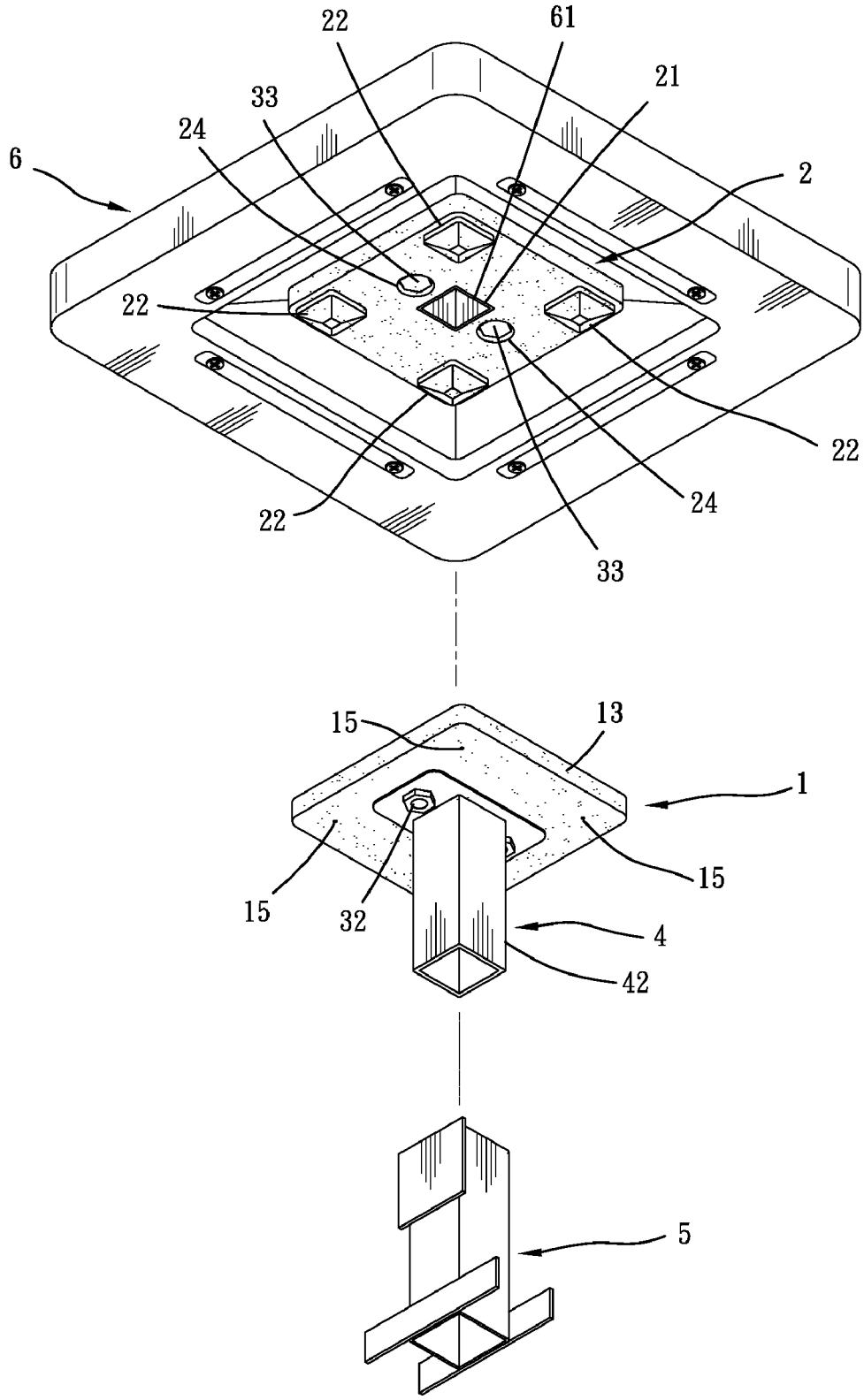
FIG. 6 is similar to FIG. 5, showing the flexible coupling plate fastened to the base and the flexible mounting plate fastened to the positioning member.
Figure 7:
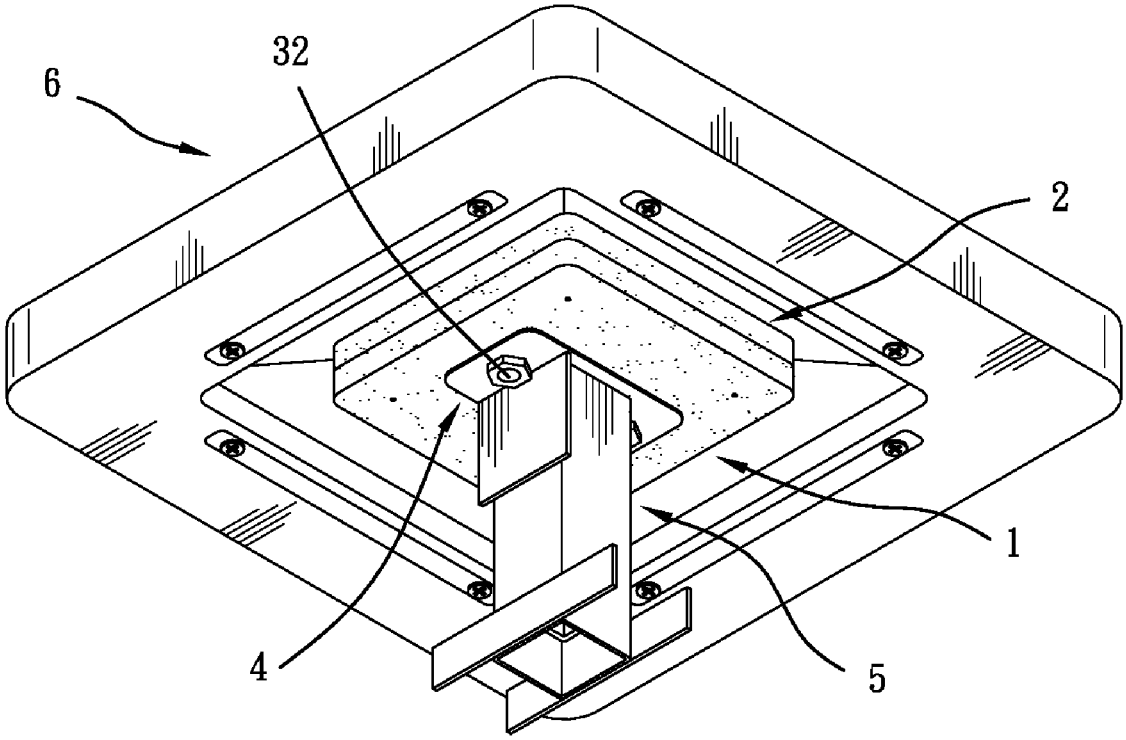
FIG. 7 is an oblique bottom elevational assembly view of the safety baseball base in accordance with the present invention.
Figure 8:
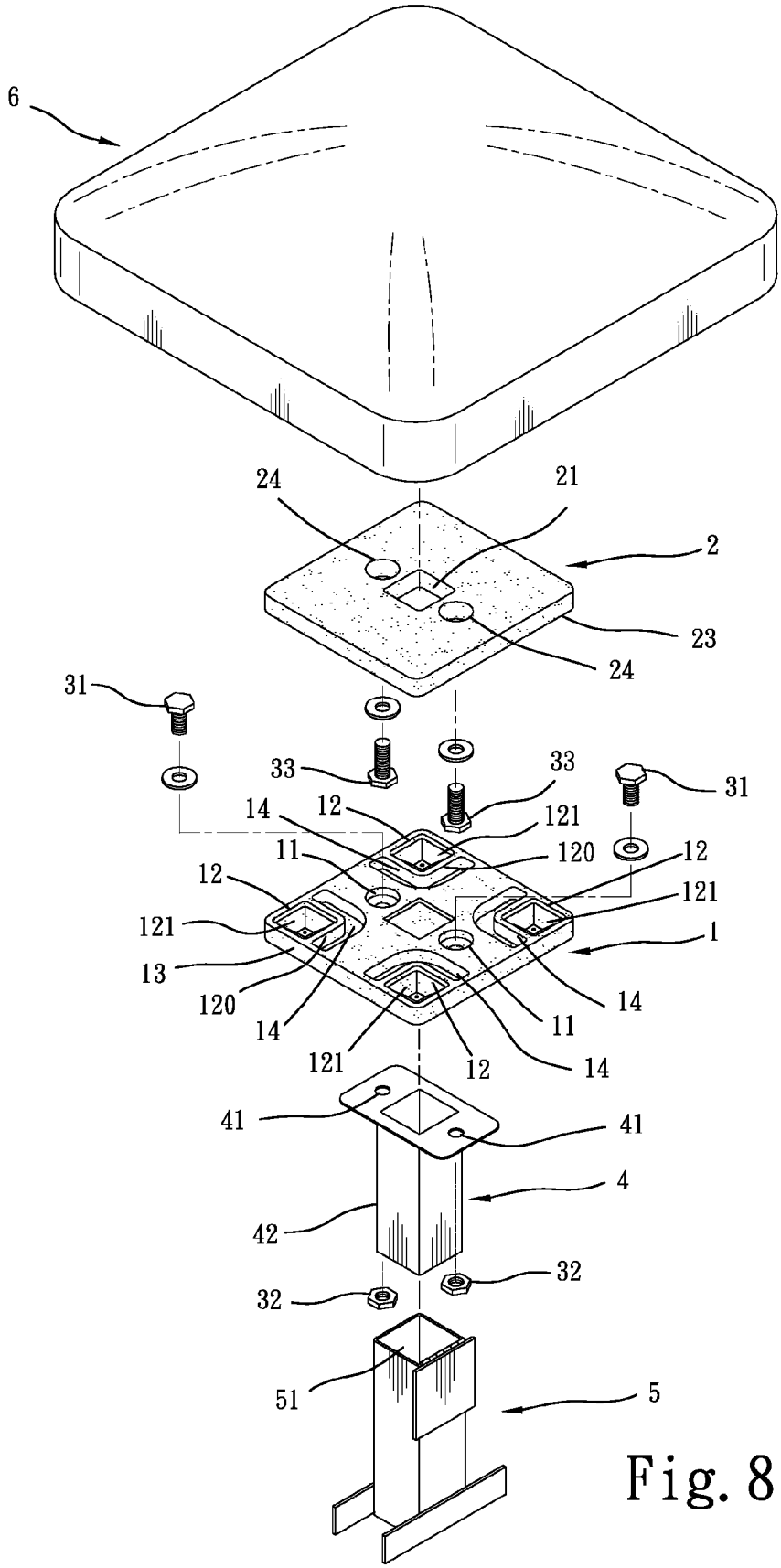
FIG. 8 is an exploded oblique top view of the safety baseball base in accordance with the present invention.
Figure 9:
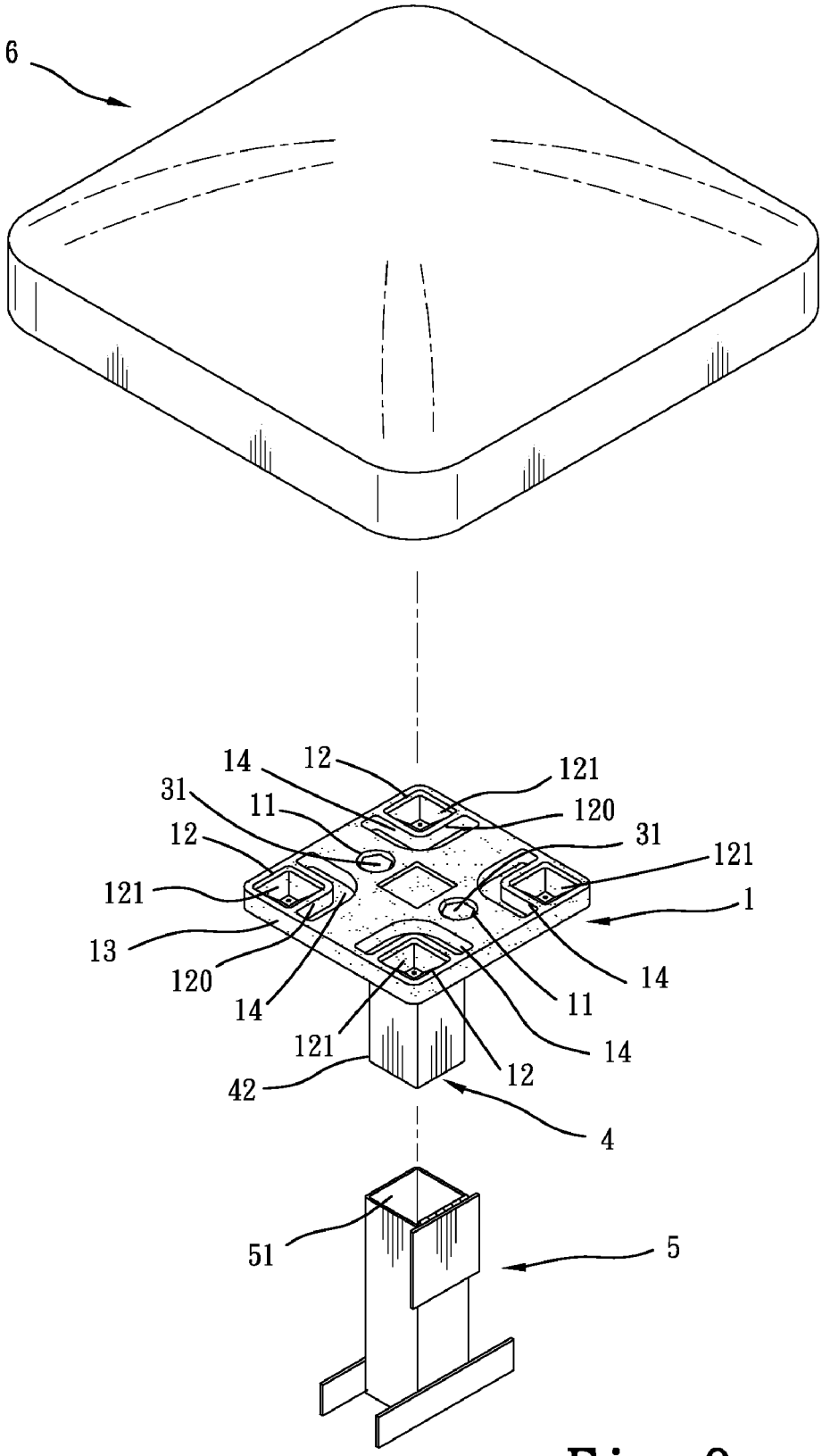
FIG. 9 is an exploded oblique top view of the present invention after fixation of the flexible mounting plate to the positioning member and the flexible coupling plate to the base.
Figure 10:
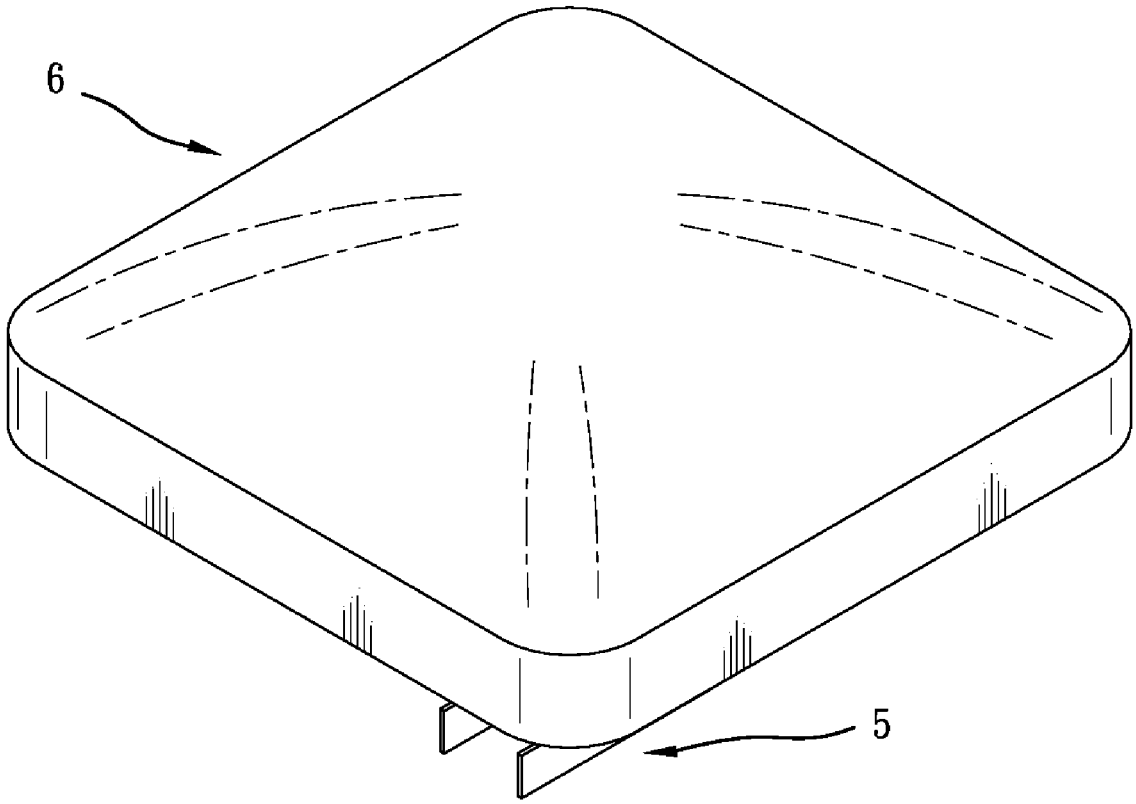
FIG. 10 is an oblique top elevational assembly view of the safety baseball base in accordance with the present invention.
Figure 11:
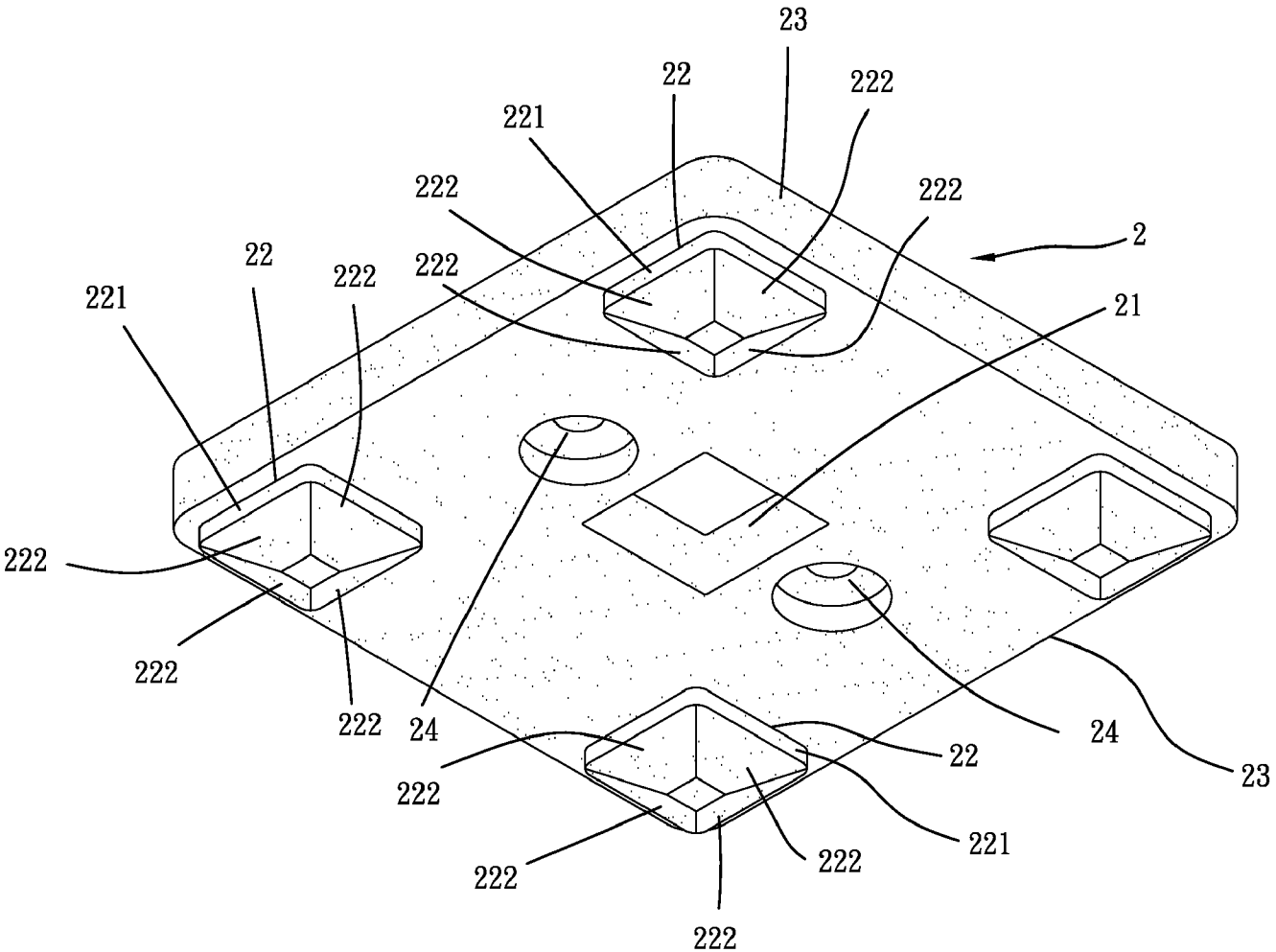
FIG. 11 is an enlarged view of a part of FIG. 5, showing the structure of the flexible coupling plate.
Figure 12:
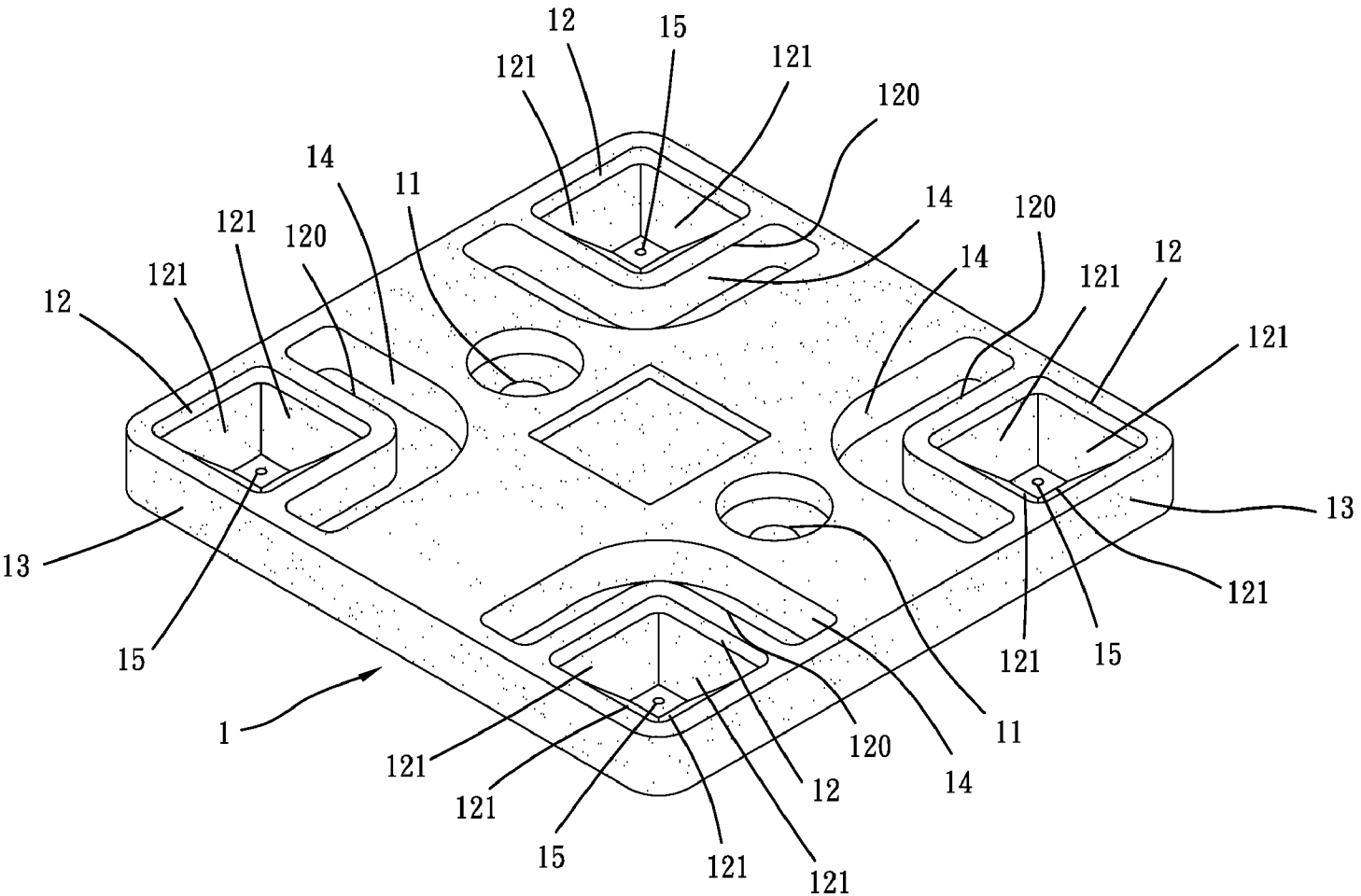
FIG. 12 is an enlarged view of a part of FIG. 8, showing the structure of the flexible mounting plate.

As shown in FIGS. 5, 8 and 11, the coupling plate 2 is press-fitted into the bottom recess 60 of the base 60, having a rectangular center coupling hole 21 coupled to the bottom stem 61 of the base 6, a plurality of bottom locating blocks 22 downwardly protruded from the bottom wall and respectively fastened to the recessed holes 12, and a plurality of mounting through holes (countersunk holes) 24 respectively fastened to the bottom mounting holes 62 by screws 33. Further, the coupling plate 2 is made out of a flexible material, such as natural rubber, artificial rubber, or thermoplastic rubber. Each bottom locating block 22 has a peripheral wall 221 press-fitted into the recessed holes 12, and a plurality of sloping inside walls 221 extending the peripheral wall 221 downwardly toward each other and respectively abutted against the sloping inside walls 121 of the mounting plate 1. The bottom locating blocks 22 are disposed in the four corners of the coupling plate 2 close to the periphery 23 of the coupling plate 2.

Figure 13:
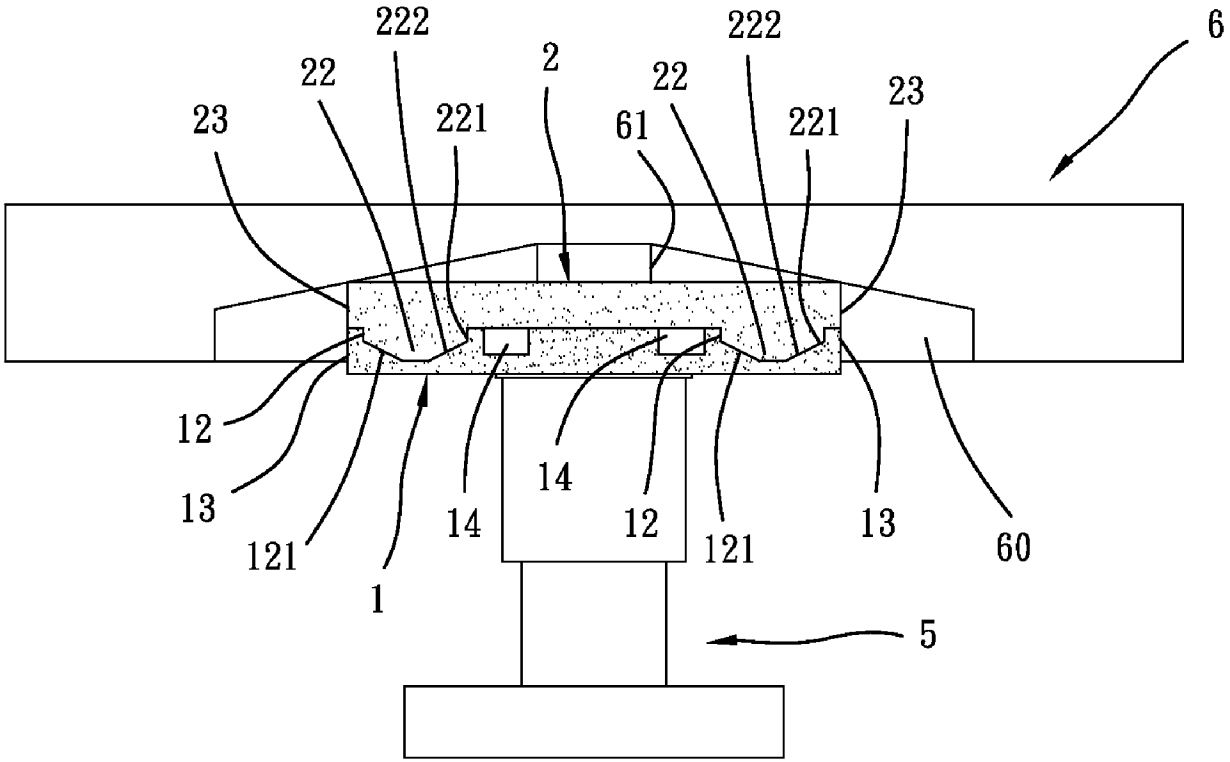
FIG. 13 is a sectional assembly plan view of the safety baseball base in accordance with the present invention.
Figure 14:
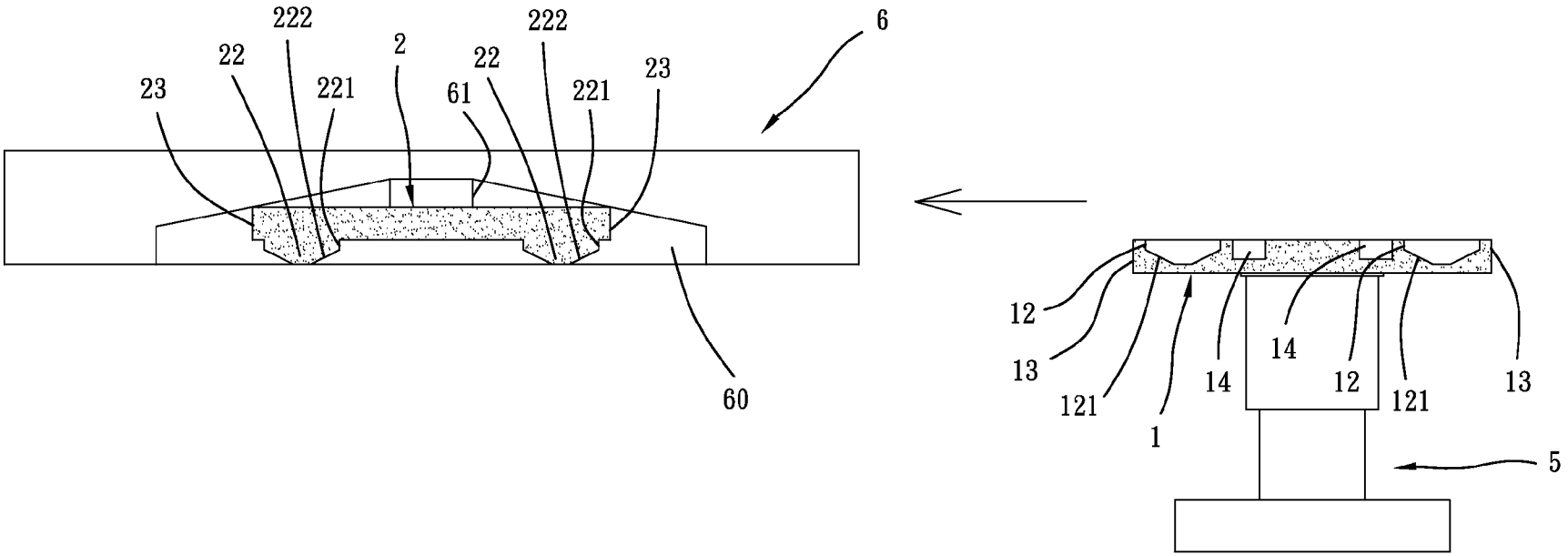
FIG. 14 is a schematic plan view of the present invention, showing the base and the flexible coupling plate disconnected from the flexible mounting plate.

After installation of the baseball base in the baseball field, the bottom locating blocks 22 of the coupling plate 2 are kept press-fitted into the recessed holes 12 of the mounting plate 1 (see FIG. 13). When the base 6 receives a high impact force as a player slides into first, second or third base during a game, the base 1 and the affixed flexible coupling plate 2 will be forced away from the mounting plate 1 (see FIG. 14), avoiding injuries.

Further, the aforesaid coupling plate 2 and mounting plate 1 can be respectively fastened to the base and positioning member of a conventional baseball base with fastening members (screws 31 and 33 and nuts 32) so that the conventional baseball base can achieve the same safety effect.

Referring to FIGS. 8 and 12 again, the mounting plate 1 further has a plurality of grooves 14 formed on the top side and respectively extending around the peripheral wall 120 of each recessed hole 12 so that the peripheral wall 120 of each recessed hole 12 is highly compressible to facilitate disconnection of the base 1 with the flexible coupling plate 2 from the mounting plate 1 upon an impact between the base 1 and a player sliding into the baseball base.

Referring to FIG. 12 again, the mounting plate 1 further has a plurality of air vents 15 respectively cut through the recessed holes 12.

As stated above, the invention provides a baseball base that has the following features and advantages:

1. When the base 6 receives a high impact force as a player slides into first, second or third base during a game, the base 1 and the affixed flexible coupling plate 2 will be forced away from the mounting plate 1 (see FIG. 14), avoiding injuries.

2. The coupling plate 2 and the mounting plate 1 can be used with a conventional baseball base and respectively fastened to the base and positioning member of the conventional baseball base with fastening members (screws 31 and 33 and nuts 32) so that the conventional baseball base can achieve the same safety effect.

3. The mounting plate 1 has a plurality of grooves 14 formed on the top side and respectively extending around the peripheral wall 120 of each recessed hole 12 so that the peripheral wall 120 of each recessed hole 12 is highly compressible to facilitate disconnection of the base 1 with the flexible coupling plate 2 from the mounting plate 1 upon an impact between the base 1 and a player sliding into the baseball base.

What is claimed is:

1. A baseball base, comprising:

a base, said base comprising a bottom recess, a bottom stem downwardly suspending at the center of said bottom recess, and a plurality of bottom mounting holes formed in said bottom recess around said bottom stem;

an anchor fixedly fastened to the ground of a baseball field in a flush manner, said anchor having a receptacle;

a positioning member inserted into said receptacle of said anchor for securing said base to said anchor, said positioning member having a plurality of mounting through holes disposed at a top side thereof, wherein a flexible mounting plate is fixedly mounted on said positioning member, said flexible mounting plate having a plurality of mounting through holes respectively fastened to the mounting through holes of said positioning member with fastening members, a plurality of recessed holes respectively formed on a top side thereof, each said recessed hole having a plurality of sloping inside walls, and wherein a flexible coupling plate fitted into said bottom recess of said base and fastened to said base and detachably coupled to said flexible mounting plate to detachably secure said base to said flexible mounting plate, said flexible coupling plate comprising a center through hole coupled to the bottom stem of said base, a plurality of mounting through holes respectively affixed to the bottom mounting holes of said base with respective fastening members, and a plurality of bottom locating blocks respectively inserted into said recessed holes of said flexible mounting plate to detachably secure said flexible coupling plate to said flexible mounting plate.

2. The baseball base as claimed in claim 1, wherein each said bottom locating block of said flexible coupling plate has a plurality of sloping walls respectively abutted against the sloping inside wall of the associating recessed hole of said flexible mounting plate.

3. The baseball base as claimed in claim 1, wherein said flexible mounting plate is made out of one of the rubber materials of natural rubber, synthetic rubber and thermoplastic rubber.

4. The baseball base as claimed in claim 1, wherein said recessed holes of said flexible mounting plate are respectively disposed adjacent to the periphery of said flexible mounting plate.

5. The baseball base as claimed in claim 1, wherein said flexible coupling plate is made out of one of the rubber materials of natural rubber, synthetic rubber and thermoplastic rubber.

6. The baseball base as claimed in claim 1, wherein said bottom locating blocks of said flexible coupling plate are respectively disposed adjacent to the periphery of said flexible coupling plate.

7. The baseball base as claimed in claim 1, wherein said recessed holes of said flexible mounting plate comprises a plurality of grooves formed on the top side thereof and respectively extending around said recessed holes.

8. The baseball base as claimed in claim 1, which is one of the first base, second base and third base in a baseball field.

* * * * *